US006397771B1

(12) United States Patent
Levi et al.

(10) Patent No.: US 6,397,771 B1
(45) Date of Patent: Jun. 4, 2002

(54) RETRACTABLE WING KEEL FOR SAILBOATS

(76) Inventors: Clark Levi, 3333 Pine Cir.; James B. Martin, 1106 Hanley Rd., both of Ocean Springs, MS (US) 39564

( * ) Notice: Subject to any disclaimer, the term of this patent is extended or adjusted under 35 U.S.C. 154(b) by 0 days.

(21) Appl. No.: 09/604,015

(22) Filed: Jun. 26, 2000

(51) Int. Cl.[7] ..... B63B 3/38
(52) U.S. Cl. ..... 114/140
(58) Field of Search ..... 114/39.24, 274, 114/279, 280, 282, 127–143

(56) References Cited

U.S. PATENT DOCUMENTS

| | | | | | |
|---|---|---|---|---|---|
| 83,420 | A | | 10/1868 | Stoner et al. | |
| 1,061,826 | A | | 5/1913 | Didlake | |
| 2,553,372 | A | | 5/1951 | Hurst | |
| 2,569,270 | A | * | 9/1951 | Wilson | 114/141 |
| 3,324,815 | A | | 6/1967 | Morales | |
| 4,686,922 | A | * | 8/1987 | Burroughs | 114/124 |
| 5,152,238 | A | | 10/1992 | Page | |
| 6,019,059 | A | * | 2/2000 | Kelsey | 114/274 |

FOREIGN PATENT DOCUMENTS

| | | | | |
|---|---|---|---|---|
| DE | 2942071 | * | 4/1981 | 114/140 |
| FR | 2563177 | * | 10/1985 | 114/282 |
| GB | 1581627 | * | 12/1980 | 114/282 |
| WO | WO 89/09159 | * | 10/1989 | 114/140 |

* cited by examiner

*Primary Examiner*—Ed Swinehart
(74) *Attorney, Agent, or Firm*—Wenderoth, Lind & Ponack, L.L.P.

(57) ABSTRACT

This invention pertains to a retractable wing keel for sailboats. A keel member is movably attached to the bottom of the sailboat, and a wing member is attached to the bottom of the keel member. In a first embodiment, the keel member is pivotally attached to the bottom of the sailboat and the wing member is pivotally attached to the bottom of the keel member. In a second embodiment, the keel member is slidably attached to the bottom of the sailboat and the wing member is fixedly attached to the bottom of the keel member.

20 Claims, 3 Drawing Sheets

RETRACTABLE WING KEEL FOR SAILBOATS

BACKGROUND THE INVENTION

This invention relates to water crafts and particularly to sailboats having keel structures for improving the lateral stability of the sailboats when pointing the sailboats. The lateral stability provided by the keel structure enables a sailboat to better hold its course.

The keel structure includes a keel member and a wing member attached thereto. In one embodiment the keel member is slidably attached to the sailboat, and the wing member is fixed to the keel member. In a second embodiment the keel member is pivotally attached to the sailboat, and the wing member is pivotally attached to the keel member.

Keels are commonly provided on the bottom of sailboats to add stability to the sailboats by preventing the sailboats from heeling. Larger sailboats have been provided with fixed keels, while smaller sailboats have been provided with vertically moveable keels or dagger boards. While these fixed keels and dagger boards do increase the stability of the sailboats to which they are attached, the stability is not always sufficient to allow these sailboats to hold their course when pointing, and especially when pointing high, i.e. sailing close to the wind. Additionally, because of the fixed keels of the larger sailboats, these sailboats cannot be sailed in shallow water. Also, in deeper water the size of the fixed keels limits the speed of the sailboats. Whether sailing for recreational purposes or competitive purposes, the most enjoyment can be obtained when the sailboat is stable and versatile, such that it can be controlled as desired by its captain in changing water depths and wind conditions.

OBJECTS OF THE INVENTION

It is a primary object of the invention to improve the lateral stability of a sailboat when pointing the sailboat.

It is another object of the invention to enable a sailboat to easily be sailed in shallow water.

It is a further object of the invention to enable a sailboat to be sailed in deeper water at increased speeds.

SUMMARY OF THE INVENTION

The water craft of the present invention is preferably a sailboat provided with a wing keel. In a first embodiment of the invention the wing keel comprises a keel member that is pivotally attached to the bottom of the sailboat, and a wing member that is pivotally attached to the bottom of the keel member. As the sailboat is being sailed the force of the water will pivot the keel member towards the bottom of the sailboat, and also pivot the wing member such that it is generally parallel to the water surface. When the wing member pivots such that it is generally parallel to the water surface, a greater generally horizontal surface area is presented to the water, whereby the sailboat is provided with enhanced stability in all water depths and wind conditions while performing sailing maneuvers, such as pointing. Also, because the keel member pivots towards the bottom of the sailboat the draft is reduced, whereby the sailboat can be sailed in shallow water. This reduced draft also enables the sailboat to be sailed at greater speeds in deeper water.

In a second embodiment of the invention the sailboat includes a vertically adjustable keel member having a wing member fixed to the bottom thereof. The wing member is fixed to the bottom of the keel member such that the wing member extends generally parallel to the water surface during sailing of the sailboat, whereby stability of the sailboat is improved as with the first embodiment. And, because the keel member is vertically adjustable the draft can be reduced, whereby the sailboat can be sailed in shallow water and can also be sailed in deeper water at a greater speed, like in the first embodiment

DESCRIPTION OF THE PREFERRED EMBODIMENT

Figure 1:
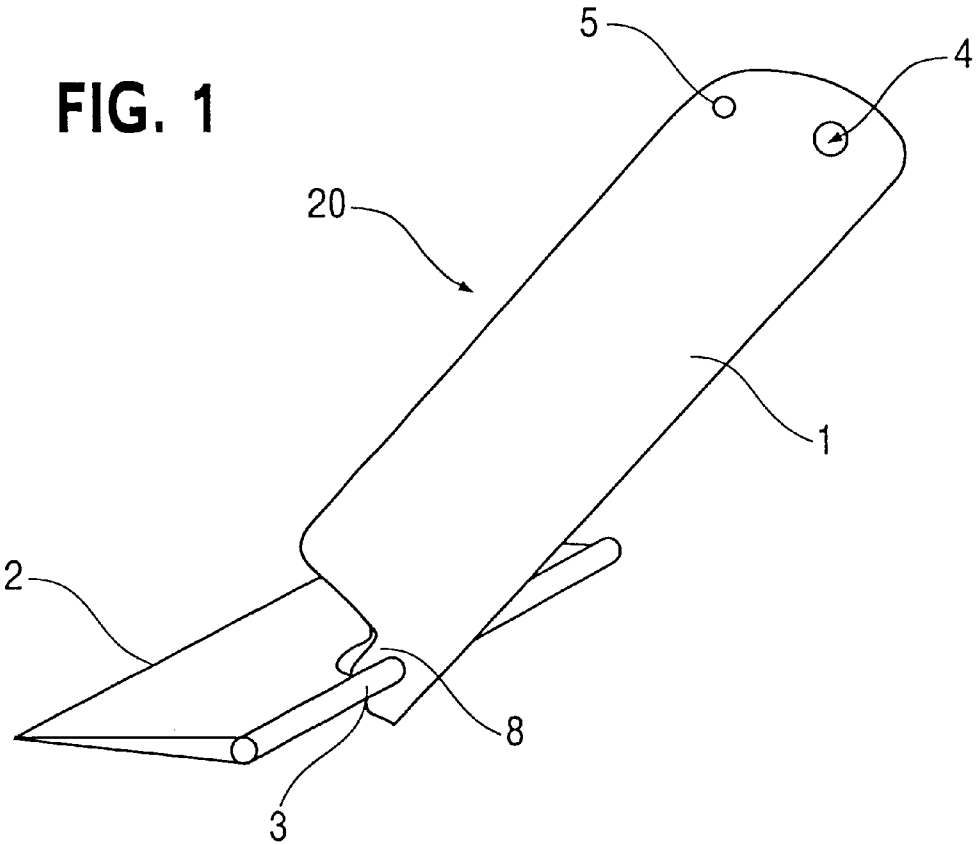
FIG. 1 is a perspective view showing the keel of the first embodiment of the invention.
Figure 2:
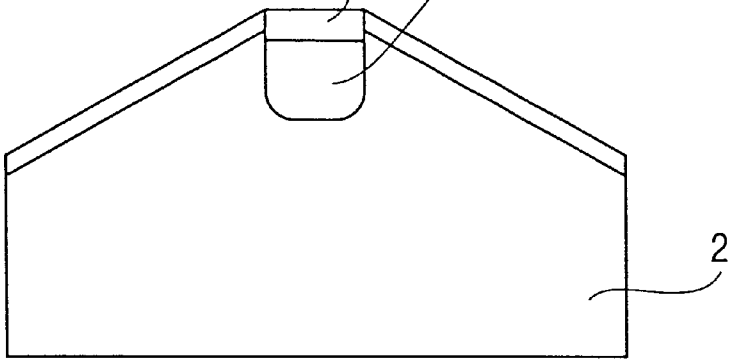
FIG. 2 is a plan view of a wing member of the keel of the first embodiment of the invention.

Referring to FIG. 1, there is shown a keel 20, having a keel member 1 and a wing member 2. The keel member 1 is pivotally attachable to the bottom of a water craft or sailboat by passing a pivot pin through hole 4 and corresponding portions of the sailboat (not shown). The wing member 2 is pivotally attached to the keel member 1 as generally shown at 3 by passing a hinge pin 6 of the wing member 2, as shown in FIG. 2, through a hole in protrusion 8 of the keel member 1. The wing member 2 projects laterally from both sides of the keel member 1.

Figure 4C:
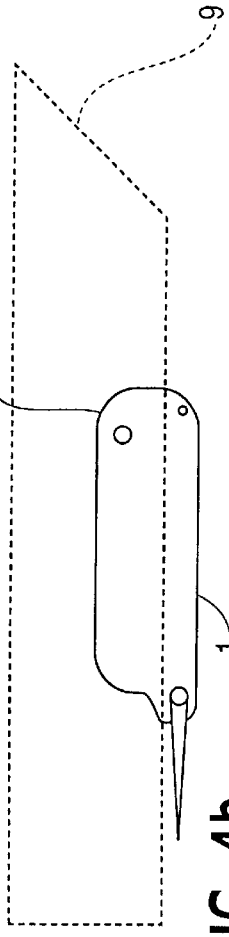
FIG. 4*c* is a view similar to that of FIG. 4*a*, but showing another different position of the keel.
Figure 4B:
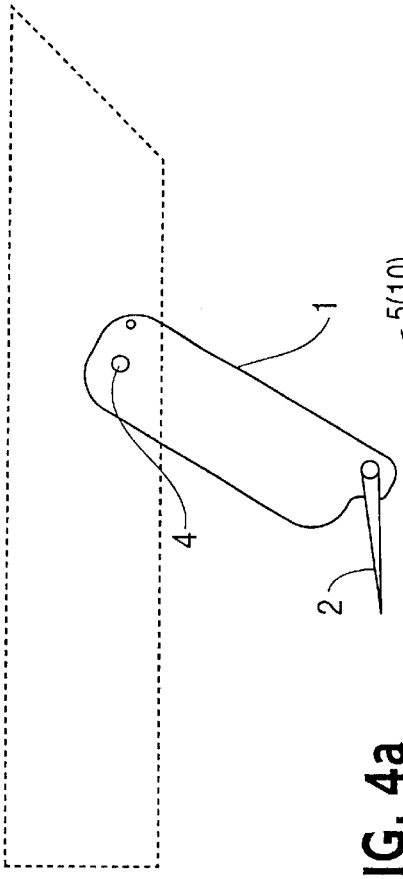
FIG. 4*b* is a view similar to that of FIG. 4*a*, but showing a different position of the keel.
Figure 4A:
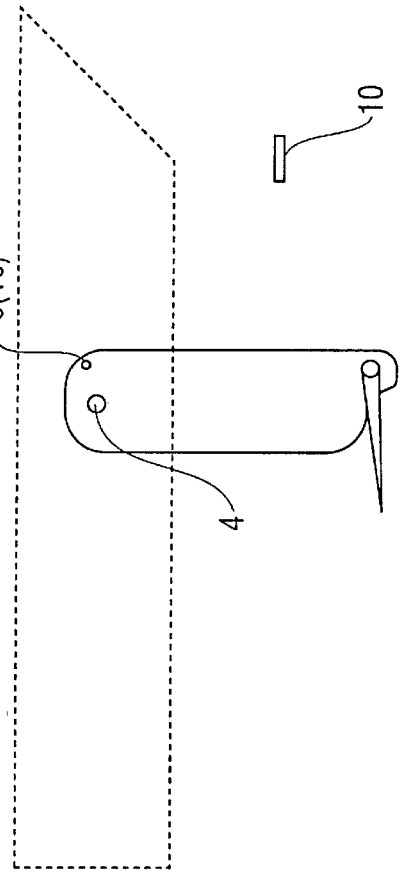
FIG. 4*a* is a schematic side view of a sailing water craft having the keel of the first embodiment of the invention attached thereto.

Referring to FIG. 2, the wing member 2 of this specific embodiment comprises a member having a first surface defined by two intersecting planes, a second opposite surface, and two side surfaces that interconnect the first surface with the second surface. The wing member 2 can have a cross-sectional shape that tapers from the first surface towards the second surface. In the first surface there is provided a recess 7, and spanning this recess is the hinge pin 6. The hinge pin 6 is received within the opening of the protrusion 8 such that the recess 7 receives the protrusion 8. When the wing member 2 is subjected to a fluid flow it pivots relative to the keel member 1. Accordingly, during sailing of the sailboat the wing member 2 attains a generally horizontal or parallel position relative to the water surface, with the first surface defining a leading edge of the wing member 2. This generally horizontal or parallel position will be attained irrespective of the orientation of the keel member 1 relative to the sailboat, as shown in FIGS. 4*a*–4*c*, that depict a sailboat while being sailed. During sailing, the force of the water flowing past the keel will pivot the keel member 1 towards the bottom of the boat, and will also pivot the wing member 2 such that it becomes oriented generally parallel to the water surface or the bottom of the sailboat 9 as explained previously. When not subjected to a fluid flow, the wing member 2 is allowed to pivot away from this generally horizontal or parallel orientation.

Because the wing member 2 attains a generally horizontal orientation during sailing of the sailboat 9, a greater surface area is presented to the water which enhances the stability of the sailboat 9 in any water depth and wind condition. This enhanced stability enables the sailboat to hold its course when pointing, and especially when pointing high, i.e. sailing close to the wind.

Figure 3:
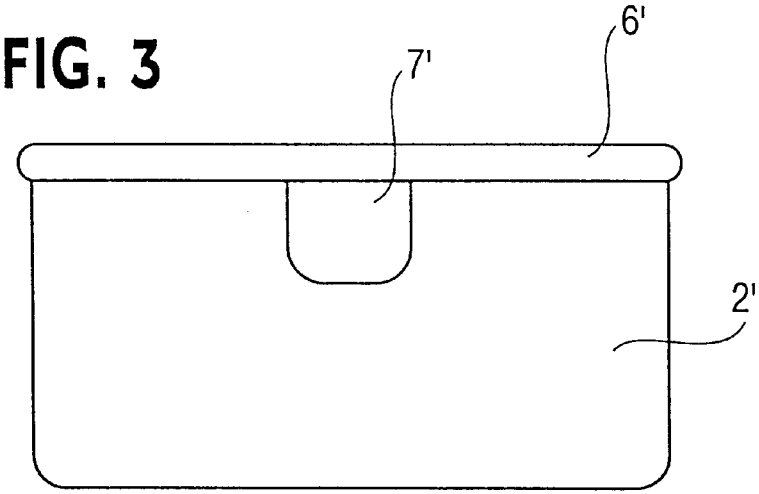
FIG. 3 is a plan view of an alternative wing member of the keel of the first embodiment of the invention.
Figure 5A:
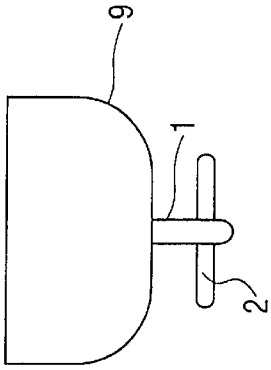
FIG. 5*a* is a front view of the water craft shown in FIG. 4*c*.
Figure 5B:
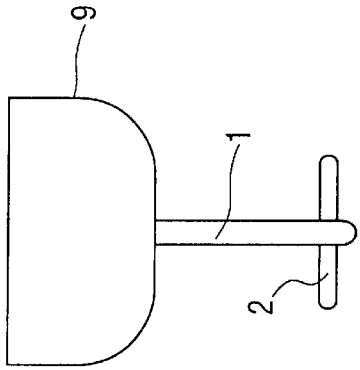
FIG. 5*b* is a front view of the water craft as shown in FIG. 4*a*.

FIG. 3 shows an alternative embodiment or shape of the wing member. In the specific embodiment of FIG. 3, wing member 2' has its first surface defined by a single plane as opposed to the two intersecting planes of wing member 2 as depicted in FIG. 2. Like wing member 2, wing member 2' has a recess 7' and a hinge pin 6'. Hinge pin 6' is received in the opening in the protrusion 8 of the keel member 1 such that wing member 2' pivots relative to keel member 1, as does wing member 2 described above. Accordingly, wing member 2' attains a generally horizontal or parallel position relative to the bottom of the sailboat during sailing of the sailboat, regardless of the position of keel member 1 relative to the bottom of the sailboat. As such, the enhanced stability as discussed above is also realized for wing member 2'.

As explained above, because the wing member 2, 2' attains a generally horizontal or parallel position relative to the bottom of the sailboat, stability of the sailboat is improved during the sailing thereof. Furthermore, because the keel member 1 pivots relative to the bottom of the sailboat during sailing thereof, the speed at which the sailboat 9 sails can be increased due to the reduced draft. This reduced draft also allows the sailboat to be sailed in shallow water. Additionally, because the wing member 2, 2' attains a generally horizontal or parallel position relative to the bottom of the sailboat and the water surface, additional lift can be generated, which also can increase the speed of the sailboat.

Should the water depth or speed of the sailboat not be a factor, then the keel can be locked in the position shown in FIG. 4*a*. In this regard, the keel member 1 is provided with an opening 5, which opening receives a pin 10 that cooperates with the sailboat 9 to lock the keel member 1 in the position shown in FIG. 4*a*. Because the draft in this arrangement is maximized, the speed of the sailboat is less than it could be were the pin 10 removed and the keel member 1 allowed to freely pivot as shown in FIGS. 4*b* and 4*c*. On the other hand, this increased draft further enhances the stability of the sailboat.

Figure 6:
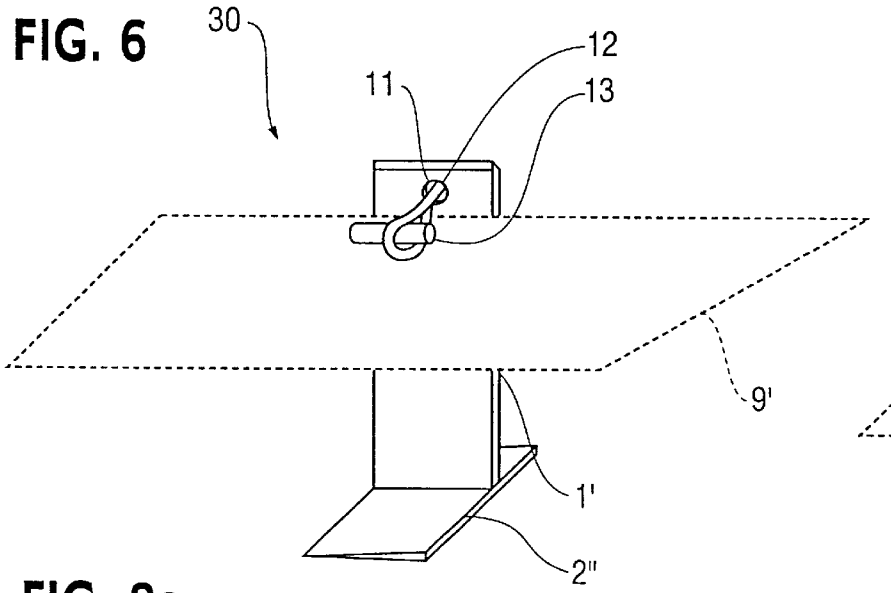
FIG. 6 is a schematic view showing a keel and water craft in accordance with a second embodiment of the invention.
Figure 8A:
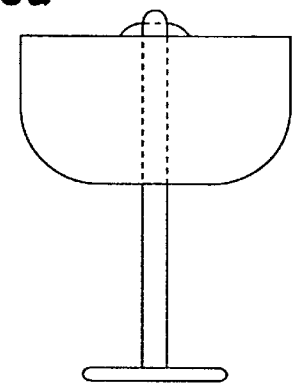
FIG. 8*a* is a front view of the water craft as shown in FIG. 6.

Referring to FIG. 6, there is shown a second embodiment of the invention. In FIG. 6 is shown a keel 30 that is slidably attached to the sailboat. This keel 30 includes a keel member 1' and a fixed wing member 2" projecting laterally therefrom. The bottom of the sailboat 9' is provided with an opening that receives the keel member 1'. The keel member 1' can be locked in its lowest position as shown in FIG. 6 by passing a rope or strap 12 through a hole 11 provided in a top portion of the keel member 1', and then tying or otherwise securing the rope or strap to a cleat or other fastening structure carried by the sailboat. When sailing in deeper water, and when speed of the sailboat is not an issue, locking the keel 30 in this lowest position will provide the greatest stability of the sailboat.

The wing member 2" of the specific embodiment of FIG. 6 is oriented generally orthogonal to the keel member 1'. Accordingly, the wing member 2" is oriented generally parallel or horizontal relative to the bottom of the sailboat or the water surface, during sailing of the sailboat. Thus, as explained with regard to the first embodiment, this orientation enhances the stability of the sailboat.

Figure 7:
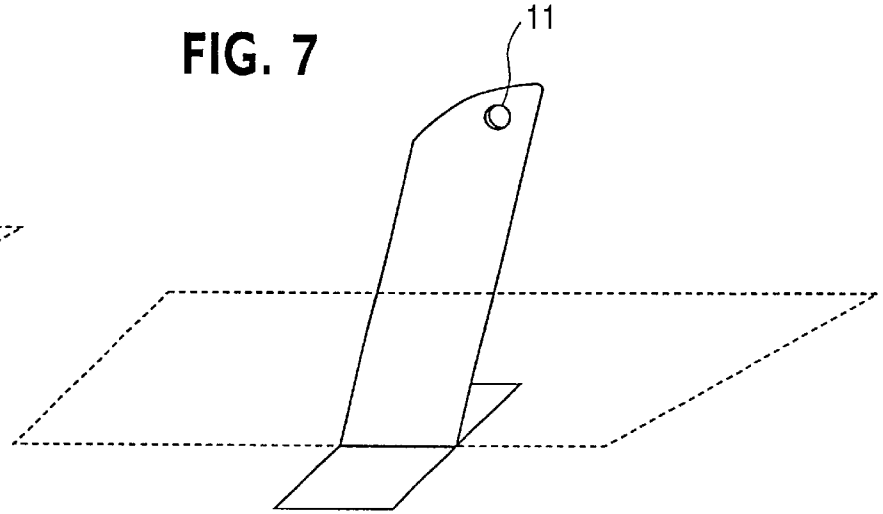
FIG. 7 is a figure similar to FIG. 6 but showing the keel in its retracted condition.
Figure 8B:
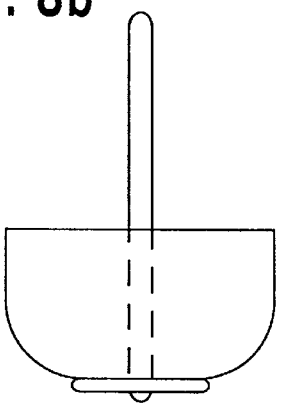
FIG. 8*b* is a front view of the water craft as shown in FIG. 7.

When desiring to increase the speed of the sailboat, or when sailing in shallow water, the keel 30 can be raised to its upper most position as shown in FIG. 7. In this regard, the rope or strap 12 is untied or removed from the cleat 13 such that the keel member 1' can be raised to its upper most position.

In each embodiment, the keel member and wing member can be fiberglass, foam surrounded by fiberglass, or any other suitable material.

While preferred embodiments of this invention have been illustrated and described, it will be obvious to those skilled in the art that various changes and modifications may be made therein without departing from the scope of the invention as defined in the appended claims.

What is claimed is:

1. A keel for attachment to a water craft, comprising:

a keel member pivotally attachable to a bottom of the water craft, with said keel member including two opposing sides, a top portion and a bottom portion defining a protrusion with an opening; and a wing member pivotally attached to said keel member, with said wing member including a first surface, a second surface defining a recess, and a hinge member extending across said recess, and wherein said wing member projects laterally from said two opposing sides of said keel member, wherein said wing member is pivotally attached to said keel member by rotatably receiving said hinge member within said opening such that said protrusion is received within said recess, whereby said wing member is pivotal to a position in which said first surface extends generally parallel to the bottom of the water craft.

2. The keel according to claim 1, wherein said keel member is pivotally attachable to the bottom of the water craft such that said keel member is pivotal between a first position in which said opposing sides extend generally orthogonally from the bottom of the water craft and a second position in which said opposing sides extend generally parallel to the bottom of the water craft, and further comprising a lock to maintain said keel member in said first position.

3. The keel according to claim 1, wherein said lock includes an opening in said top portion, and a pin receivable within said opening.

4. The keel according to claim 3, wherein said second surface is defined by a single plane or two intersecting planes.

5. The keel according to claim 4, wherein said wing member comprises fiberglass or foam surrounded by fiberglass.

6. The keel according to claim 1, wherein said second surface is defined by a single plane or two intersecting planes.

7. The keel according to claim 6, wherein said wing member comprises fiberglass or foam surrounded by fiberglass.

8. The keel according to claim 1, wherein said wing member comprises fiberglass or foam surrounded by fiberglass.

9. A water craft, comprising:

a body having a top surface and a bottom surface;

a keel member pivotally attached to said bottom surface, with said keel member including two opposing sides, a top portion and a bottom portion defining a protrusion with an opening; and a wing member pivotally attached to said keel member, with said wing member including a first surface, a second surface defining a recess, and a hinge member extending across said recess, and wherein said wing member projects laterally from said two opposing sides of said keel member, wherein said wing member is pivotally attached to said keel member by rotatably receiving said hinge member within said opening such that said protrusion is received within said recess, whereby said wing member is pivotal to a position in which said first surface extends generally parallel to said bottom surface.

10. The water craft according to claim 9, wherein said keel member is pivotally attached to said bottom surface such that said keel member is pivotal between a first position in which said opposing sides extend generally orthogonally from said bottom surface and a second position in which said opposing sides extend generally parallel to said bottom surface, and further comprising a lock to maintain said keel member in said first position.

11. The water craft according to claim 10, wherein said lock includes an opening in said top portion, and a pin receivable within said opening.

12. The water craft according to claim 11, wherein said second surface is defined by a single plane or two intersecting planes.

13. The water craft according to claim 12, wherein said wing member comprises fiberglass or foam surrounded by fiberglass.

14. The water craft according to claim 9, wherein said second surface is defined by a single plane or two intersecting planes.

15. The water craft according to claim 14, wherein said wing member comprises fiberglass or foam surrounded by fiberglass.

16. The water craft according to claim 9, wherein said wing member comprises fiberglass or foam surrounded by fiberglass.

17. A keel for attachment to a water craft, comprising:

a keel member including two opposing sides, wherein said keel member is pivotally attachable to a bottom of the water craft such that said keel member is pivotable about a first axis when attached to the bottom of the water craft between a first position in which said opposing sides extend generally orthogonally from the bottom of the water craft and a second position in which said opposing sides extend generally parallel to the bottom of the water craft;

a wing member pivotally attached to said keel member such that said wing member is pivotable about a second axis that extends substantially parallel to the first axis, with said wing member projecting laterally from said two opposing sides of said keel member; and a lock to maintain said keel member in said first position, said lock including an opening in said top portion and a pin receivable within said opening.

18. The keel according to claim 17, wherein said wing member comprises fiberglass or foam surrounded by fiberglass.

19. A water craft, comprising:

a body having a top surface and a bottom surface;

a keel member including two opposing sides, wherein said keel member is pivotally attached to said bottom surface such that said keel member is pivotable about a first axis between a first position in which said opposing sides extend generally orthogonally from said bottom surface and a second position in which said opposing sides extend generally parallel to said bottom surface;

a wing member pivotally attached to said keel member such that said wing member is pivotable about a second axis that extends substantially parallel to the first axis, with said wing member projecting laterally from said two opposing sides of said keel member; and a lock to maintain said keel member in said first position, said lock including an opening in said top portion and a pin receivable within said opening.

20. The water craft according to claim 19, wherein said wing member comprises fiberglass or foam surrounded by fiberglass.

* * * * *